US008794734B2

(12) United States Patent
Owaki

(10) Patent No.: US 8,794,734 B2
(45) Date of Patent: Aug. 5, 2014

(54) LIQUID EJECTING HEAD AND LIQUID EJECTING APPARATUS

(75) Inventor: Hiroshige Owaki, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 184 days.

(21) Appl. No.: 13/426,504

(22) Filed: Mar. 21, 2012

(65) Prior Publication Data

US 2012/0242739 A1 Sep. 27, 2012

(30) Foreign Application Priority Data

Mar. 23, 2011 (JP) ..... 2011-063647

(51) Int. Cl.
*B41J 29/38* (2006.01)

(52) U.S. Cl.
USPC ..... 347/17

(58) Field of Classification Search
None
See application file for complete search history.

(56) References Cited

U.S. PATENT DOCUMENTS 4,459,469 A * 7/1984 Ishima ..... 347/17
6,575,547 B2 * 6/2003 Sakuma ..... 347/18
7,686,407 B2 * 3/2010 Usui ..... 347/9
2006/0170735 A1 * 8/2006 Hong et al. ..... 347/68
2007/0052764 A1 * 3/2007 Oku ..... 347/68

FOREIGN PATENT DOCUMENTS

JP 2004-345109 A 12/2004
JP 2006-205735 A 8/2006

* cited by examiner

*Primary Examiner* — Matthew Luu
*Assistant Examiner* — Tracey McMillion
(74) *Attorney, Agent, or Firm* — Kilpatrick Townsend & Stockton LLP

(57) ABSTRACT

A liquid ejecting head includes a flow channel forming substrate made of silicon and having pressure generating chambers that communicate with nozzles through which liquid is ejected, a piezoelectric elements that is disposed on the flow channel forming substrate so as to oppose the pressure generating chambers and varies a pressure of a liquid in the pressure generating chambers, and a protective substrate which has a holding section that houses the pressure generating unit and is bonded to a side of the flow channel forming substrate where the pressure generating unit is disposed, and the flow channel member is made of silicon and is provided with a thermistor that is disposed on a side of the flow channel member opposite to the flow channel forming substrate.

3 Claims, 5 Drawing Sheets

LIQUID EJECTING HEAD AND LIQUID EJECTING APPARATUS

BACKGROUND

1. Technical Field

The present invention relates to liquid ejecting heads and liquid ejecting apparatuses and is particularly useful when applied to the case where a drive waveform of the liquid ejecting head is appropriately selected depending on the temperature of a liquid to be ejected in order to control ejection properties of the liquid.

2. Related Art

A typical example of liquid ejecting heads that eject liquid droplets includes, for example, an ink jet recording head having a flow channel forming substrate on which pressure generating chambers are formed and a piezoelectric actuator disposed on one side of the flow channel forming substrate so as to correspond the pressure generating chambers and is configured such that the displacement of the piezoelectric actuator causes a pressure to be applied to the pressure generating chambers, thereby ejecting ink droplets through nozzles that are formed so as to penetrate a nozzle plate in the thickness direction.

In this type of ink jet recording head, the ejection properties of ink depend on the viscosity of the ink, and the viscosity depends on the temperature of the ink. Therefore, a drive waveform has been controlled by appropriately selecting and/or changing the drive waveform that drives the piezoelectric actuator depending on a temperature measured by a thermistor.

Such a thermistor, however, is disposed on a circuit board as one of electronic components. In this configuration, the thermistor measures an atmospheric temperature, which may be significantly different from the actual temperature of ink ejected from the nozzles.

In order to improve the ejection properties of ink, it is important to measure the temperature of ink to be ejected with a higher accuracy. Accordingly, various configurations have been proposed as a solution to measure the temperature of ink to be ejected through the nozzles with a higher accuracy, such as that disclosed in JP-A-2004-345109 and JP-A-2006-205735.

JP-A-2004-345109 describes that the recording head is formed by bonding a heat generating substrate and a flow channel substrate, and a temperature sensor is embedded in the heat generating substrate.

Further, JP-A-2006-205735 describes that an insulation film is disposed on a lower electrode that is formed on the flow channel forming substrate, and a thermistor which is a temperature detection sensor is disposed on the top of the insulation film so as to be insulated from the lower electrode via the insulation film.

In the configuration described in JP-A-2004-345109, since the temperature sensor is embedded in the heat generating substrate while being in contact with ink, the insulation property of the electrode or the like seems not to be ensured. Further, in the configuration described in JP-A-2006-205735, since the temperature detection sensor is disposed on the top of the insulation film so as to be insulated from the lower electrode formed on the flow channel forming substrate via the insulation film, problems occur in that the configuration of this portion becomes complicated and the accuracy of the measurement is reduced by measuring the ink temperature via the lower electrode film and the insulation film.

In addition, such problems exist not only in the ink jet recording head that eject ink, but also in the liquid ejecting head that eject liquid other than ink.

SUMMARY

An advantage of some aspects of the invention is that a liquid ejecting head and a liquid ejecting apparatus including a temperature sensor that is capable of accurately measuring the temperature of a liquid to be ejected are provided in order to eject the liquid with an appropriate drive waveform depending on the viscosity of the liquid.

According to an aspect of the invention, there is provided a liquid ejecting head that includes a flow channel forming substrate made of silicon and having pressure generating chambers that communicate with nozzles through which liquid is ejected, a pressure generating unit that is disposed on the flow channel forming substrate so as to oppose the pressure generating chambers and varies a pressure of a liquid in the pressure generating chambers, and a flow channel member which has a holding section that houses the pressure generating unit and is bonded to a side of the flow channel forming substrate where the pressure generating unit is disposed, and the flow channel member is made of silicon and is provided with a temperature sensor that is disposed on a side of the flow channel member opposite to the flow channel forming substrate. Accordingly, in the above aspect of the invention, the heat representing the temperature of the liquid to be ejected from the nozzles is transmitted via the silicon substrate having good heat conductivity and the flow channel member which is also made of silicon substrate and then detected by the temperature sensor. As a result, the temperature of the liquid can be measured with a high accuracy.

Preferably, according to the above aspect of the invention, the temperature sensor has a lead wire for electrical connection, and the lead wire is connected to the substrate on which a circuit that drives the pressure generating unit is formed. Accordingly, the temperature information measured by the temperature sensor can be successfully sent to a specific substrate or the like through the wiring of the substrate.

Further, according to another aspect of the invention, there is provided a liquid ejecting apparatus that includes the above liquid ejecting head and is configured to switch a drive waveform to drive the pressure generating unit in accordance with a temperature detected by the temperature sensor. Since the heat representing the temperature of the liquid to be ejected from the liquid ejecting head can be detected with a high accuracy, the liquid ejecting head can be accordingly driven with an appropriate drive waveform. As a result, the liquid ejecting apparatus capable of improving the quality of printed products or the like can by achieved by improving the ejection properties of the liquid.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
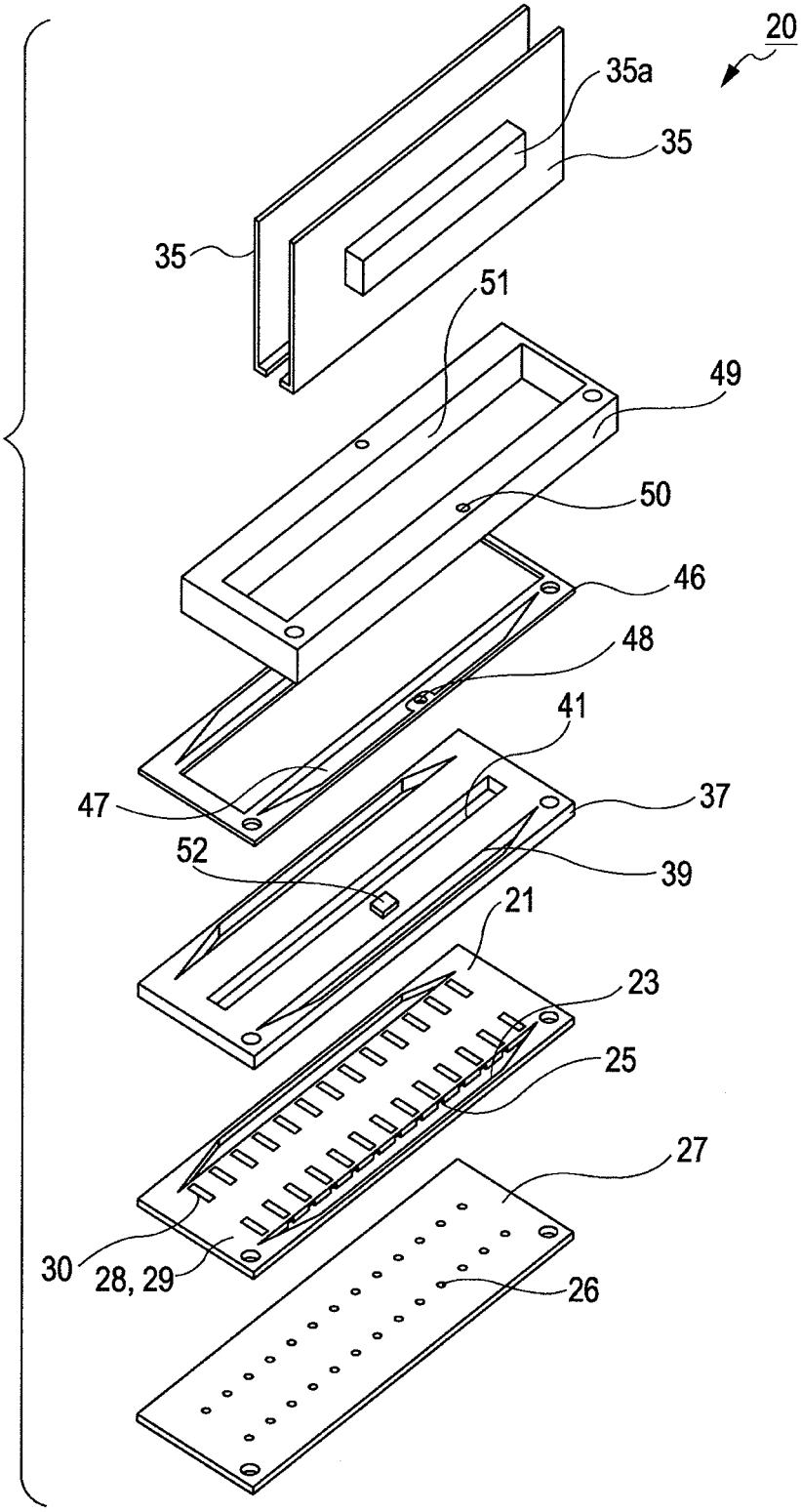
FIG. 1 is an exploded perspective view of a recording head according to an embodiment.

The invention will be described below in detail with reference to an embodiment. FIG. 1 is an exploded perspective view of an ink jet recording head (hereinafter, simply referred to as a recording head) as an example of a recording head according to an embodiment of the invention, and FIG. 2 is a sectional view of pressure generating chambers of the recording head in the longitudinal direction.

Figure 2:
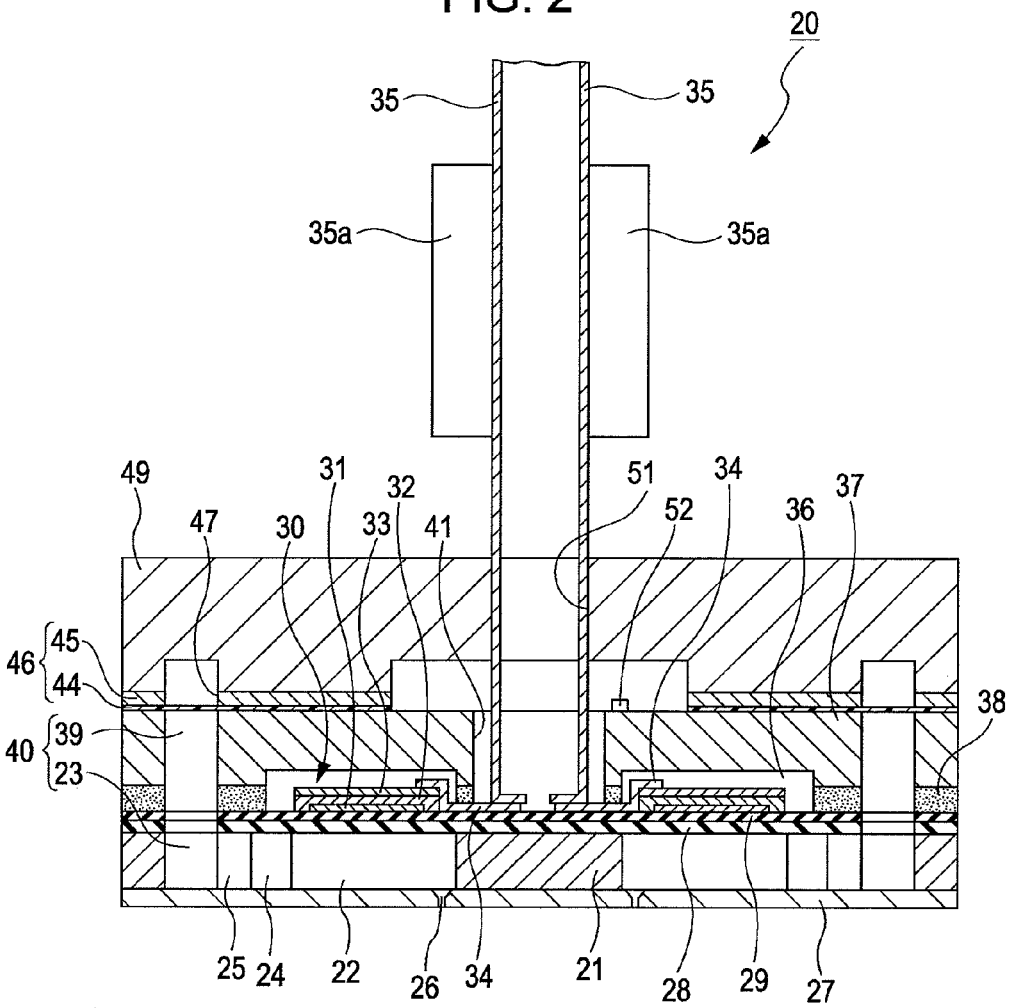
FIG. 2 is a sectional view of pressure generating chambers of the recording head in the longitudinal direction according to an embodiment.

As shown in FIGS. 1 and 2, a recording head 20 includes a flow channel forming substrate 21 having a plurality of pressure generating chambers 22 that are arranged in two rows in the width direction. Further, communication sections 23 are formed on the outer side relative to the pressure generating chambers 22 in the longitudinal direction so that the communication section 23 and the respective pressure generating chambers 22 communicate via ink supplying paths 24 and communication paths 25 that are formed for each of the pressure generating chambers 22. The flow channel forming substrate 21 according to the embodiment is made of a silicon substrate in which the pressure generating chambers 22 and the like are formed by etching.

One side of the flow channel forming substrate 21 is bonded to a nozzle plate 27 in which nozzles 26 are formed by drilling such that each nozzle 26 communicates with the proximity of one end of the pressure generating chamber 22 which is opposite to the end where the ink supplying path 24 is formed.

Further, piezoelectric elements 30 are disposed on the other side of the flow channel forming substrate 21, which is opposite to the side of the nozzle plate 27, with an elastic film 28 and an insulator film 29 interposed therebetween. The piezoelectric element 30 is composed of a first electrode 31, a piezoelectric body layer 32 and a second electrode 33. The second electrode 33 that constitutes the piezoelectric element 30 is connected to a lead electrode 34 which extends on the insulator film 29. While one end of the lead electrode 34 is connected to the second electrode 33, the other end is connected to a COF substrate 35 on which a drive IC 35*a* for driving the piezoelectric elements 30 is mounted. Thus, one end of the COF substrate 35 is connected to the lead electrode 34, and the other end of the COF substrate 35 is connected to a circuit board (not shown) which is secured to a case member (not shown) which is located above the recording head 20.

A protective substrate 37 is bonded to the flow channel forming substrate 21 on which the piezoelectric elements 30 are disposed by using an adhesive 38. The protective substrate 37 has piezoelectric element holding sections 36 disposed at positions corresponding to the piezoelectric elements 30 as a space for protecting the piezoelectric elements 30. Further, manifold sections 39 are formed in the protective substrate 37. The manifold section 39 according to the embodiment is configured to form a manifold 40 that communicates with communication section 23 of the flow channel forming substrate 21 and serves as an ink chamber for all the pressure generating chambers 22.

Further, a through hole 41 is also formed in the protective substrate 37 so as to penetrate the protective substrate 37 in the thickness direction. The through hole 41 according to the embodiment is disposed between two piezoelectric element holding sections 36. The proximity of the end of the lead electrode 34 that is led out from each piezoelectric element 30 is exposed to the outside through the through hole 41.

The protective substrate 37 is made of a silicon substrate on which the piezoelectric element holding sections 36, the manifold sections 39 and the like are formed by etching the silicon substrate. A thermistor 52 which is a temperature sensor is disposed on the side of the protective substrate 37 (the upper side in FIG. 2) that is opposite to the side of the flow channel forming substrate 21 so that the temperature on the top of the protective substrate 37 is measured. The detailed configuration such as a connection configuration of this area will be described below.

Further, a compliance substrate 46 which is composed of a sealing film 44 and a fixation plate 45 is bonded to the protective substrate 37. The sealing film 44 is made of a flexible material having low rigidity and is provided to seal one side of the manifold section 39. The fixation plate 45 is made of a hard material such as a metal. The areas of the fixation plate 45 that correspond to the manifolds 40 are completely removed in the thickness direction to form openings 47. Accordingly, one side of the manifold 40 is sealed only with the flexible sealing film 44. Further, the compliance substrate 46 has ink introduction ports 48 through which ink is introduced into the manifold 40.

A headcase 49 is secured on the compliance substrate 46. The headcase 49 has ink introduction paths 50 that communicate with the ink introduction ports 48 so that ink is supplied from a storing unit such as a cartridge to the manifolds 40. The headcase 49 also has a wiring member holding hole 51 that communicates with the through hole 41 formed on the protective substrate 37, and one end of the COF substrate 35 is connected to the lead electrode 34 while the COF substrate 35 is inserted through the wiring member holding hole 51.

Figure 3:
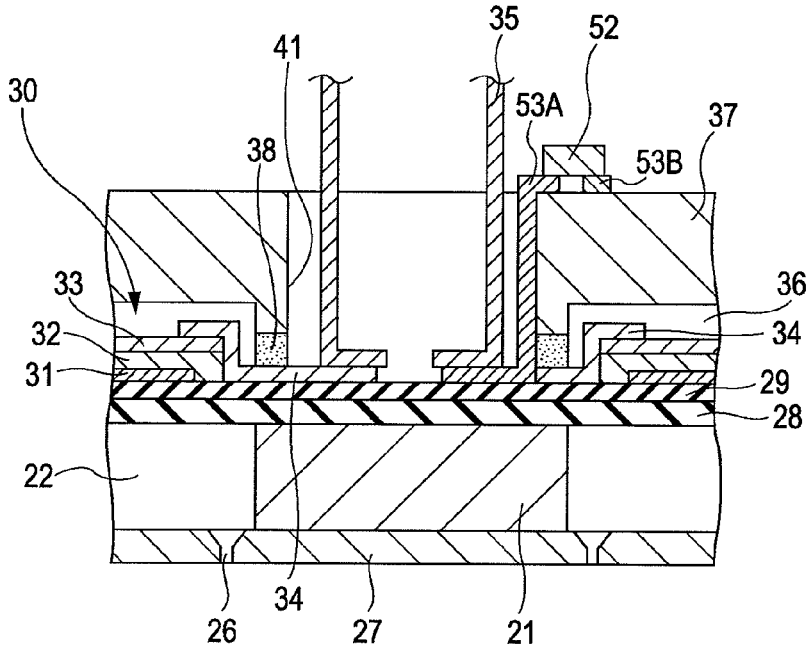
FIG. 3 is an enlarged view which shows a thermistor portion of FIG. 2.

FIG. 3 is an enlarged view which shows a thermistor portion of FIG. 2. As shown in FIG. 3, two lead wires 53A and 53B of the thermistor 52 are both connected to the COF substrate 35. That is, the lead wires 53A and 53B extend along the wall surface of the protective substrate 37 that faces the through hole 41 from the top to the bottom of the protective substrate 37 and are connected to two wires of the COF substrate 35 on the top of the insulator film 29, similarly to the lead electrodes 34, and further connected to a circuit board (not shown), and then, connected to a specific external circuit. The lead wire 53B is grounded there. Therefore, as a matter of course, only the lead wire 53A may be connected to the wire of the COF substrate 35, and the lead wire 53B may be separately connected to a ground potential.

Figure 4:
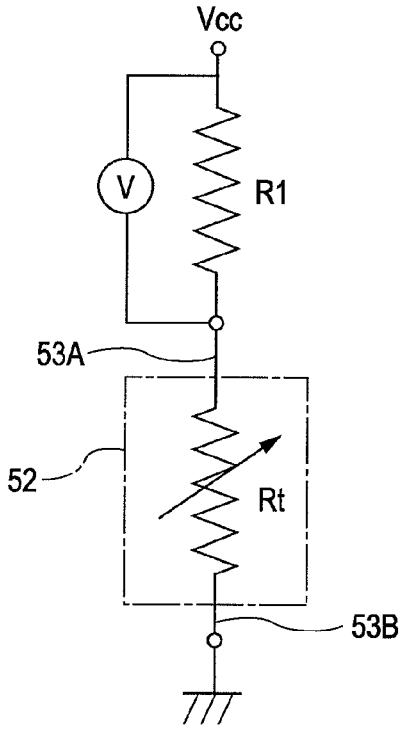
FIG. 4 is a circuit diagram which shows an equivalent circuit of a portion that includes the thermistor.

FIG. 4 is an example of an equivalent circuit of the temperature measurement portion in this embodiment. As shown in FIG. 4, a thermistor 52 which is a variable resistance Rt that varies the resistance value depending on the temperature is connected to a fixed resistance R1 in serial. Accordingly, the temperature to be measured can be detected via the resistance value of the variable resistance Rt by measuring the voltage at both ends of the fixed resistance R1 with a voltage meter V. The voltage measured with the voltage meter V is given as a value of a power-supply voltage Vcc divided by division ratio that is determined by a resistance value between the fixed resistance R1 and the variable resistance Rt.

Figure 6:
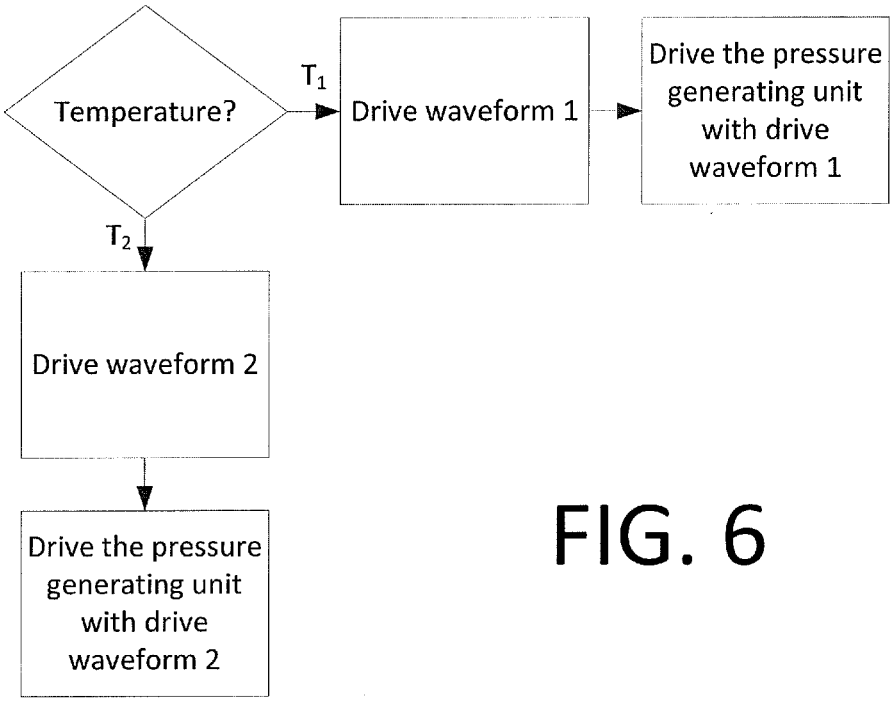
FIG. 6 is a flow chart which shows a switch of a drive waveform to drive a pressure generating unit in accordance with a temperature detected by a temperature sensor.

In the recording head 20, the piezoelectric elements 30 are driven by specific drive signals. As a result, ink droplets are ejected from the pressure generating chambers 22 through the nozzles 26 by means of a pressure generated in the pressure generating chambers 22. Referring to FIG. 6, since the thermistor 52 that is disposed on the protective substrate 37 detects temperature information which reflects the ink temperature, appropriate drive signals can be selected based on the temperature information, and the piezoelectric elements 30 can be driven with the selected drive signals. Since the temperature detected with the thermistor 52 is a temperature of the protective substrate 37 that is made of a silicon substrate and has a good heat conductivity, the temperature reflects the actual ink temperature with a high accuracy. In addition, the flow channel forming substrate 21 accurately conducts the ink temperature of the pressure generating chambers 22 and the communication section 23, while the protective substrate 37 accurately conducts the temperature of the manifold section 39.

Therefore, the drive signals based on the temperature information also can be of optimal waveform, taking the ink temperature into consideration.

Other Embodiment

Although an embodiment of the invention has been described above, the basic configuration of the invention is not limited to the above description. For example, although in the above-mentioned embodiment, the lead wires 53A and 53B of the thermistor 52 are configured to be connected to the COF substrate 35 and led out to the outside, the configuration is not limited to this embodiment. The position of the thermistor 52 is not limited, as long as the thermistor 52 is disposed on the top of the protective substrate 37 which serves as the flow channel member. Accordingly, with the configuration in which the IC on the protective substrate is connected to the lead electrode by, for example, wire bonding, it is also possible to configure such that the signals of the thermistor 52 are output by using an FPC whose one end is connected to the top of the protective substrate.

Although in the above-mentioned embodiment, the pressure generating unit that generates a pressure change in the pressure generating chamber 22 is explained as a thin film type piezoelectric element 30, the pressure generating unit is not specifically limited to the above description. It is possible to use other type of piezoelectric actuator such as, for example, a thick film type piezoelectric actuator that is formed by attaching a green sheet or the like, or a vertical vibration type piezoelectric actuator that is formed by alternately stacking a piezoelectric material and an electrode forming material so as to expand and contract in the axial direction. Further, as a pressure generating unit, a heat generating element may be disposed in the pressure generating chamber so as to generate bubbles by heat from the heat generating element, thereby ejecting liquid droplets from the nozzles, or a so-called static actuator may be used to generate static electricity between the vibration plate and the electrode so as to deform the vibration plate by electrostatic force, thereby ejecting liquid droplets from the nozzles.

Figure 5:
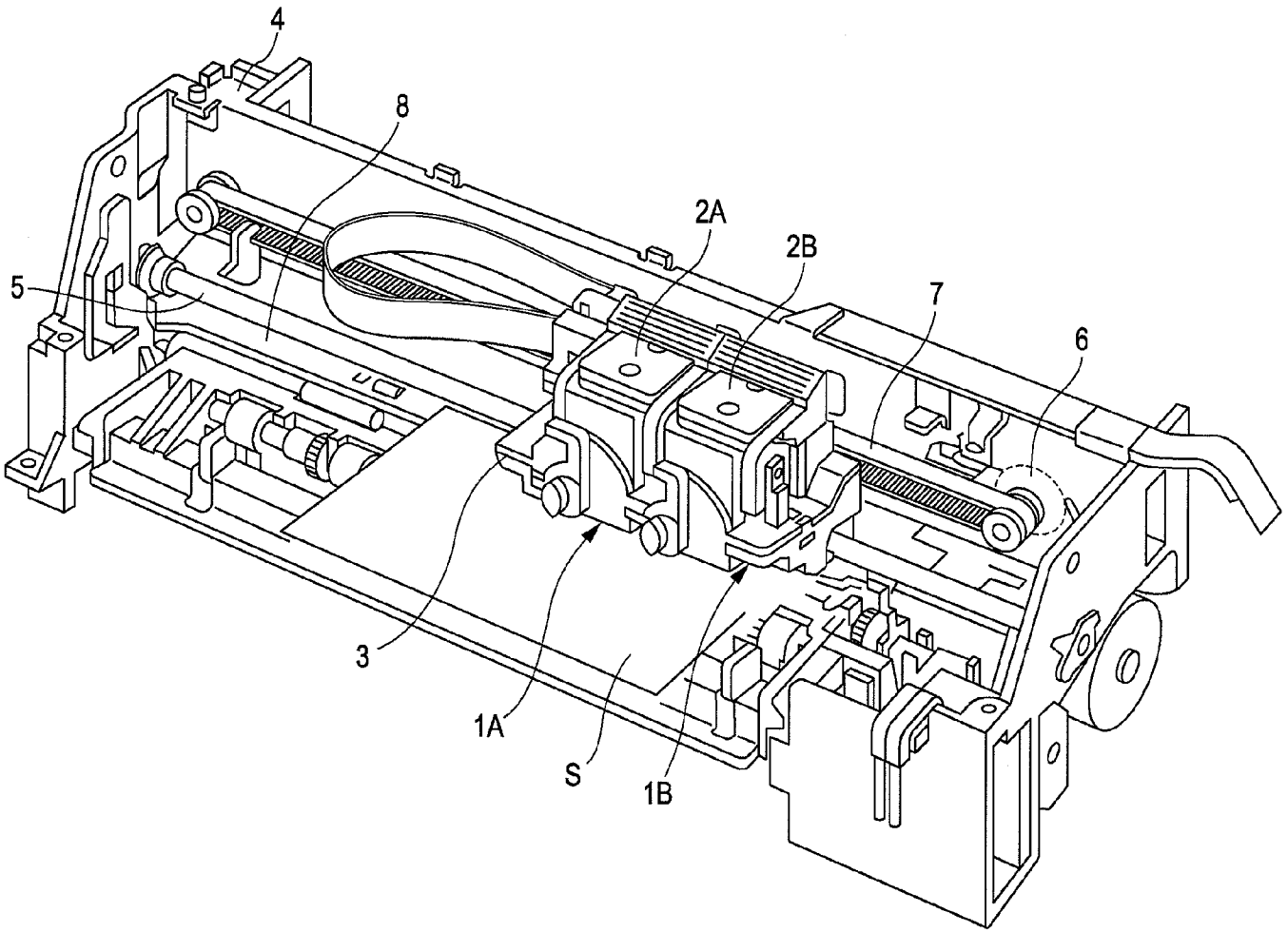
FIG. 5 is a schematic view which shows an example of an ink jet recording apparatus according to an embodiment.

The ink jet recording head according to the above-mentioned embodiment, which forms part of the recording head unit having an ink flow channel that communicates with an ink cartridge or the like, is mounted in the ink jet recording apparatus. FIG. 5 is a schematic view which shows an example of such an ink jet recording apparatus. As shown in FIG. 5, cartridges 2A and 2B that constitute ink supplying unit is detachably mounted on recording head units 1A and 1B having an ink jet recording head according to the above-mentioned embodiment. A carriage 3 on which the recording head units 1A and 1B are mounted is disposed on a carriage shaft 5, which is secured to an apparatus body 4, to be movable in the axial direction. The recording head units 1A and 1B are configured to eject, for example, black ink compositions and color ink compositions, respectively.

When a driving force of a drive motor 6 is transmitted to the carriage 3 via a plurality of gears, which are not shown, and a timing belt 7, the carriage 3 on which the recording head units 1A and 1B are mounted moves along the carriage shaft 5. In addition, a platen 8 is provided in the apparatus body 4 along the carriage shaft 5 such that a recording sheet S which is a recording medium, such as a sheet of paper, supplied from a paper feeding roller or the like, which is not shown, is wound around the platen 8 and transported.

Although the above embodiment uses a so-called serial type ink jet recording apparatus in which the recording head units 1A and 1B are mounted on the carriage 3 that moves in a direction perpendicular to the transportation direction of the recording sheet S (main scan direction) so that printing is performed while the recording head units 1A and 1B move in the main scan direction, the invention is not limited to the above description. A so-called line type ink jet recording apparatus in which the recording head is provided at a fixed position and printing is performed just by transporting the recording sheet S may also be used as a matter of course.

Further, although the above embodiment has been explained by using the ink jet recording apparatus as an example of liquid ejecting apparatus, the invention is generally directed to liquid ejecting apparatuses having a liquid ejecting head, and may be applied to liquid ejecting apparatuses having a liquid ejecting head that ejects a liquid other than ink. Examples of other liquid ejecting heads include, for example, various recording heads used for image recording apparatuses for printers and the like, color material ejecting heads used for the manufacturing of the color filters for liquid crystal displays and the like, organic EL displays, electrode material ejecting heads used for forming electrode such as field emission displays (FED), and bioorganic ejecting heads used for manufacturing bio chips and the like.

The entire disclosure of Japanese Patent Application No. 2011-063647, filed Mar. 23, 2011 is incorporated by reference herein.

What is claimed is:

1. A liquid ejecting head, comprising:

a flow channel substrate made of silicon and having pressure generating chambers that communicate with nozzles through which liquid is ejected;

a pressure generating unit that is disposed on the flow channel substrate so as to oppose the pressure generating chambers and varies a pressure of a liquid in the pressure generating chambers;

a flow channel member comprising a holding section that houses the pressure generating unit, wherein the flow channel member is bonded to a side of the flow channel substrate where the pressure generating unit is disposed, the flow channel member being made of silicon;

a temperature sensor disposed on a side of the flow channel member opposite to the flow channel forming substrate, wherein the temperature sensor has a lead wire for electrical connection;

an additional substrate; and a circuit that drives the pressure generating unit, wherein the circuit is disposed on the additional substrate;

wherein the lead wire is connected to the additional substrate.

2. A liquid ejecting apparatus comprising the liquid ejecting head according to claim 1, the liquid ejecting apparatus being configured to switch a drive waveform to drive the pressure generating unit in accordance with a temperature detected by the temperature sensor.

3. A liquid ejecting apparatus comprising a liquid ejecting head, the liquid ejecting head comprising:

a flow channel forming substrate made of silicon and having pressure generating chambers that communicate with nozzles through which liquid is ejected;

a pressure generating unit that is disposed on the flow channel forming substrate so as to oppose the pressure generating chambers and varies a pressure of a liquid in the pressure generating chambers; and a flow channel member which has a holding section that houses the pressure generating unit and is bonded to a side of the flow channel forming substrate where the pressure generating unit is disposed, the flow channel member being made of silicon and provided with a temperature sensor that is disposed on a side of the flow channel member opposite to the flow channel forming substrate, wherein the temperature sensor has a lead wire for electrical connection, and the lead wire is connected to the substrate on which a circuit that drives the pressure generating unit is formed;

the liquid ejecting apparatus being configured to switch a drive waveform to drive the pressure generating unit in accordance with a temperature detected by the temperature sensor.

* * * * *